US010165802B2

(12) United States Patent
Clouse et al.

(10) Patent No.: US 10,165,802 B2
(45) Date of Patent: Jan. 1, 2019

(54) INFANT POSITIONING AND SWADDLING WRAP

(71) Applicants: Donna M. Clouse, Radcliff, KY (US); William R. Clouse, Radcliff, KY (US)

(72) Inventors: Donna M. Clouse, Radcliff, KY (US); William R. Clouse, Radcliff, KY (US)

(73) Assignee: Clouse Design, LLC, Schertz, TX (US)

( * ) Notice: Subject to any disclaimer, the term of this patent is extended or adjusted under 35 U.S.C. 154(b) by 407 days.

(21) Appl. No.: 14/756,330

(22) Filed: Aug. 27, 2015

(65) Prior Publication Data

US 2017/0055591 A1 Mar. 2, 2017

(51) Int. Cl.

| | |
|---|---|
| ***A41D 13/00*** | (2006.01) |
| ***A47C 16/00*** | (2006.01) |
| ***A61F 13/15*** | (2006.01) |
| ***A41B 13/06*** | (2006.01) |
| ***A47D 15/00*** | (2006.01) |

(52) U.S. Cl.

CPC ..... *A41B 13/06* (2013.01); *A47D 15/008* (2013.01)

(58) Field of Classification Search

CPC ..... A41B 13/06; A41B 13/065; A41B 13/103; A41B 13/10; A41B 13/106; A47B 15/008; A47B 15/02; A47D 15/001; A47D 15/008; A47D 15/08; A47G 9/0246

USPC ..... 2/69.5; 5/655, 494; 604/393

See application file for complete search history.

(56) References Cited

U.S. PATENT DOCUMENTS

| | | | | | |
|---|---|---|---|---|---|
| 2,486,114 | A | * | 10/1949 | Cataldo | A47D 15/008 128/876 |
| 2,619,958 | A | * | 12/1952 | Day | A41B 13/00 128/876 |
| 3,521,309 | A | | 7/1970 | Evans | |
| 3,779,540 | A | * | 12/1973 | Boudreau | A47D 15/008 128/876 |
| 3,845,513 | A | * | 11/1974 | Hubner | A47G 9/083 2/69.5 |
| 3,968,911 | A | * | 7/1976 | Haas | A47D 13/02 224/158 |
| 3,987,505 | A | | 10/1976 | Hickey | |
| 4,064,576 | A | | 12/1977 | Threatt | |
| 4,117,840 | A | * | 10/1978 | Rasure | A61F 5/3784 128/874 |
| 4,186,457 | A | * | 2/1980 | Amelung | A47C 27/085 5/427 |
| 4,205,669 | A | * | 6/1980 | Hamann | A47D 5/00 5/424 |
| 4,447,922 | A | * | 5/1984 | Brochu | A47D 1/103 297/391 |
| 4,597,121 | A | | 7/1986 | Bouma | |
| 4,657,005 | A | * | 4/1987 | Williamson | A41B 13/00 128/875 |
| 4,802,244 | A | * | 2/1989 | McGrath-Saleh | A41B 13/06 2/69 |

(Continued)

*Primary Examiner* — Timothy K Trieu

(74) *Attorney, Agent, or Firm* — Carrithers Law Office, PLLC

(57) ABSTRACT

A device for securely and comfortably holding and swaddling a baby in a relatively fixed position on his back horizontal or in an inclined position on a mattress in a bed. The device is removably connected to a mattress and includes a first harness wrap around the legs and waist that holds the baby in an upright position. A second swaddle wrap holds the baby's chest and can hold and snuggle his arms if desired.

22 Claims, 5 Drawing Sheets

(56) References Cited

U.S. PATENT DOCUMENTS 4,911,105 A * 3/1990 Hocum ..... A61F 5/3784 128/875
4,989,286 A * 2/1991 Tucker ..... A47D 15/008 128/872
5,208,925 A * 5/1993 Edlund ..... A47D 15/008 128/872
5,233,714 A * 8/1993 De Bell Daniel ... A47D 15/008 128/873
5,309,926 A * 5/1994 Mayton ..... A47D 5/00 128/869
5,321,863 A * 6/1994 Yamaguchi ..... A47K 10/02 2/69.5
RE34,763 E * 10/1994 Tucker ..... A47D 15/008 128/872
2,702,385 A 2/1995 Goldberg
5,400,803 A * 3/1995 Vines ..... A61F 5/3769 128/869
5,439,008 A 8/1995 Bowman
5,722,100 A * 3/1998 Jozwiak ..... A47K 3/127 4/572.1
5,746,219 A * 5/1998 McConnell ..... A47D 15/008 128/845
5,826,287 A * 10/1998 Tandrup ..... A47D 13/08 297/219.12
5,933,886 A * 8/1999 Washington ..... A47G 9/0207 5/413 R
5,950,261 A * 9/1999 Hay ..... A41B 13/06 2/69
6,009,874 A * 1/2000 Sartin ..... A47D 5/00 128/869
6,381,785 B1 * 5/2002 Mancera Browne ..... A61F 5/37 5/424
6,631,528 B2 10/2003 Landry
6,634,041 B2 * 10/2003 Higashi ..... A45C 3/10 383/4
6,681,422 B2 * 1/2004 Landry ..... A47D 15/008 128/872
6,708,356 B1 * 3/2004 LaValle ..... A47D 15/008 128/872
6,817,048 B1 * 11/2004 LaRosa ..... A41B 13/06 128/873
6,837,880 B2 * 1/2005 Trimble ..... A41B 13/00 128/872
6,848,131 B1 2/2005 Landry
6,898,812 B2 5/2005 Smart
D510,792 S * 10/2005 Vazquez ..... D2/718
7,065,814 B2 * 6/2006 Rutkowski ..... A47D 5/006 128/876
7,150,054 B1 * 12/2006 Byrne ..... A47D 15/008 128/872
7,337,481 B2 3/2008 Gilbert
7,603,732 B2 * 10/2009 Robles ..... A47D 15/008 128/872
7,673,354 B2 3/2010 Faber
8,020,226 B2 * 9/2011 Landry ..... A47D 15/008 128/872
8,082,614 B2 * 12/2011 Nour ..... A47D 13/08 5/633
8,191,188 B2 * 6/2012 Kaplan ..... A47D 15/008 2/69.5
8,302,225 B1 * 11/2012 Earnest ..... A41B 13/06 5/413 R
8,359,687 B2 * 1/2013 Marlowe ..... A47D 15/005 128/872
D690,426 S * 9/2013 Houston ..... D24/190
8,782,831 B2 * 7/2014 Houston ..... A41B 13/06 5/482
2008/0029103 A1 * 2/2008 Regev ..... A47C 20/08 128/875
2008/0222803 A1 * 9/2008 Korshamn ..... A47G 9/083 5/413 R
2010/0154122 A1 * 6/2010 Crispino ..... A47C 21/028 5/636
2010/0287706 A1 * 11/2010 Nour ..... A47D 13/08 5/655
2012/0216349 A1 8/2012 Kaplan
2013/0312198 A1 * 11/2013 Kelly ..... A47D 5/00 5/655
2016/0157642 A1 * 6/2016 Xiong ..... A47G 9/083 2/80
2017/0055591 A1 * 3/2017 Clouse ..... A47D 15/008

* cited by examiner

INFANT POSITIONING AND SWADDLING WRAP

TECHNICAL FIELD

The present invention relates to an infant positioning and swaddling device for securely and comfortably holding and swaddling a baby in a relatively fixed position on a mattress at a selected elevation.

BACKGROUND OF THE INVENTION

Newborn and premature babies are often wrapped in a blanket or the covering in order to swaddle the infant and keep the infant warm while sleeping. Babies are also wrapped or swaddled to provide a feeling of comfort, much like the closeness felt in the womb.

Premature babies are often put on a mattress in an incubator which has the upper end elevated to hold the baby in a position where the baby's head is higher than the rest of the body. Unless otherwise restrained, the newborn babies roll down the incline or eventually wind up at the bottom due to squirming and the like, defeating the purpose of inclining the mattress to hold up the head.

There are several types of blanket devices which are secured to a mattress in order to attach a sheet or blanket of a crib mattress and/or bumper pad to limit movement of the infant while sleeping. Some infants frequently change positions while sleeping so it is desirable to secure the baby in a secure sleeping position. Moreover, the risk of infant death due to Sudden infant Death Syndrome, "SIDS", is thought to be reduced by placing babies on their backs to sleep.

Parents of infants are always concerned with the safety of their child, especially when the child is not in the parents' reach, such as when the child is in someone else's care or when the child is in bed at night and the parents are in the next room. SIDS or sudden infant death syndrome is still a mystery but claims the lives of 2500 babies in the United States between one month and one year old. SIDS remains unpredictable despite years of research. Even so, the risk of SIDS can be greatly reduced. Experts have stated that infants younger than 1 year old should be placed on their backs to sleep—never face-down on their stomachs or on their sides.

Gastro-Esophageal Reflux is a condition wherein stomach contents come back up and out of the esophagus and cause burning and choking of the person. This condition is also improved by sleeping on one's back in an inclined position. In the case of an infant with this condition, some sort of restraint is needed to hold or swaddle the child in such an inclined position to help prevent stomach contents from working their way up the esophagus. Incorporating a harness assembly provides a means of preventing the infant from sliding downward on an inclined mattress.

Moreover, it is recommended to remove soft bedding from the baby's sleep area, keeping the baby's head and face uncovered during sleep and keeping blankets and other coverings away from a baby's mouth and nose by tucking the blanket in around the bottom of the crib mattress. However, merely tucking bedding around a crib mattress is not always sufficient to secure the bedding in view of the movement of active babies that kick and move around in bed.

Several devices have been utilized to secure a blanket to the mattress and hold the infant in a selected position upon the mattress.

DESCRIPTION OF THE RELATED ART

U.S. Pat. No. 5,208,925 by Edmund for SHEET FOR INCLINED INFANT MATTRESS which issued on May 11, 1993 teaches a sling which has a panel which is brought between the legs and is tied to each side of the bed. The baby's abdomen rests on a large panel portion which is also tied to each side of the baby's bed.

U.S. Pat. No. 5,400,803 for APPARATUS FOR SUPPORT OR POSITIONAL TREATMENT by Vines which issued on Mar. 28, 1995 teaches a belt arrangement around the waist and through the legs. The belt is secured to a band which encircles or is tied around the mattress.

U.S. Pat. No. 7,337,481 B2 by Gilbert for APPARATUS FOR SECURING BEDDING which issued on Mar. 4, 2008 teaches bedding including a pouch formed by two U-shaped semi-rigid members held together by magnets. The lower U-shaped member is secured to a blanket and the upper U-shaped member is attached to the blanket portion which stretches across and covers the upper U-shaped member. The U-shaped members are removably held together by a plurality of magnets. The blanket and lower U-shaped member are secured to the mattress with two C-shaped frame members which are hooked around each side of the mattress. The inclusion of rigid U-shaped members and magnets and C-shaped hook members pose the problems of unnecessary bulk and problems associated with laundering and care of the bedding articles and storage of same.

U.S. Pat. No. 6,681,422 B2 for CRIB SAFETY SHEET/BLANKET by Landry which issued on Jan. 27, 2004 teaches a blanket portion sewn to the top central portion of a fitted sheet. The blanket is sewn down a centerline of the blanket portion, leaving the two halves of the blanket portion on either side of the stitching free to wrap around a baby. The blanket is fitted with hook and loop fasteners to secure the blanket around the baby. The fitted sheet is also secured around the mattress by a plurality of straps with hook and loop fasteners. If the Landry device was used on an inclined mattress, the baby could be left dangling from the stitched portion of the blanket and would be free to tip from side to side about the centrally stitched seam.

U.S. Pat. No. 7,603,732 B2 by Robles et al. for SLEEPING INFANT POSITIONING DEVICE which issued on Oct. 20, 2009 teaches bedding which is secured by straps which circumscribe the mattress. The bedding includes a waist panel secured to a bedding panel. The waist panel includes a belt securing an upper opening and two lower openings through which the baby's legs are passed while the upper opening contains the baby's lower abdomen. Robles includes several straps for holding the bedding to the mattress and for holding the baby within the waist panel requiring unnecessary time to secure the blanket to the mattress with conventional means. Further, Robles leaves the baby's legs exposed and unrestrained.

U.S. Patent Application Publication No. 20080307577 by Leckband for BABY CRIB SAFETY BLANKET published on Dec. 18, 2008 teaches a blanket including a pouch located in the middle of an extended length of blanket material. The extra blanket material on both sides of the pouch is rolled into a coils to help restrict movement of the baby within the bed such as rolling over. Leckband's blanket is not intended to be strapped to or otherwise connected to the mattress, and is therefore not secure on an inclined mattress.

U.S. Pat. No. 5,233,714 for INFANT RESTRAINING DEVICE by De Bell Daniel which issued on Aug. 10, 1993 teaches one piece unit of fabric which is fastened around a mattress and includes a free end panel portion which is brought up between the baby's legs and includes hook and loop material or the like for fastening the free end panel to the panel portion wrapped around the mattress.

SUMMARY OF THE INVENTION

In accordance with the present invention, there is provided an infant swaddling device comprising, consisting of, or consisting essentially of a slip cover, a swaddle, and an I-shaped harness. The slip cover is made of woven synthetic or natural fabric material forming a first pocket capable of tightly and removably fitting over a head end of a baby mattress and covering about one third of said mattress. The slip cover has a top surface and an edge capable of stretching across a top surface of the baby mattress. The swaddle comprises a woven fabric panel and stretches across the width of the top surface of the slip cover. The swaddle is rectangular and has a long top edge, a long bottom edge, and two short lateral edges. The bottom long edge of the swaddle is placed directly over the edge of the top surface of the slip cover. The two short lateral edges of the swaddle are about ten to twelve inches long. The swaddle has a first patch of loop material on a top surface at one end, which stretches along the first of the two short lateral edges of the swaddle. The swaddle has three lengths of parallel patches of hook material at an opposite end of the top panel on the underside thereof which are about six inches long. The I-shaped panel comprises woven fabric having a top bar, a bottom bar and a middle bar which is perpendicular to and connects the top bar and the bottom bar at their respective centers. The top and bottom bars are about sixteen inches long and about three and one half inches wide. The middle bar is about twelve inches long. The I-shaped panel is situated with the top bar over the center of the swaddle so that the bottom edge of the top bar is also directly over the bottom edge of the swaddle. The slip cover, the swaddle and the I-shaped panel are fixedly connected to one another with thread stitched at the center of the top bar over at least a three inch by three inch area. The two free ends of the top bar have patches of hook material fixedly connected on the undersides thereof and the two free ends of the bottom bar have patches of loop material fixedly connected on a top surface thereof.

A leg pouch attached to the bottom edge of the slip cover top surface of the mattress or mattress pad by sewing, VELCRO, adhesives or other attachment means in close proximity to the harness and/or swaddle whereby the baby's legs can be tucked into the pouch for warmth. The position of the leg pouch starts at or near the bottom of the swaddle; however, the leg pouch can be attached to the bottom edge of the slip cover, bottom edge of the swaddle, or even attached to the mattress pad so long as the placement of the pouch cooperatively engaged with the swaddle and harness wrap. It has been found to secure the pouch to the bottom portion of the swaddle or slip cover for easy removal and cleaning.

The harness may include an optional leg pouch permanently or removably attached to the bottom edge of the slip cover and/or swaddle wrap. The bottom portion of the harness is folded upward so that the distal ends of the bottom side flaps of the harness overlap and cover the outside surface of the top side flaps of the harness.

The bottom side flaps of the harness are removably attached to the side panels of the harness with the hook and loop fasteners of the bottom flap cooperatively engaging corresponding hook and loop fasteners on the outer side panels of top side flaps of the harness forming a cradle limiting movement of the infant and whereby the baby's legs can be tucked into the pouch for warmth.

The swaddle and harness can be held closed by a belt, strap, or band or material that can be made adjustable by using an elastic material, hook and loop fasteners such as VELCRO, or a buckle.

It is an object of this invention to provide an infant swaddling device which comfortably holds an infant on his back on a crib mattress.

It is an object of this invention to provide an infant swaddling device which is adjustable with respect to the size of the infant and includes hook and loop fasteners for fastening the swaddle around the child.

It is an object of this invention to provide an infant swaddling device which holds the infant around the waist and holds the chest and can hold the arms as well.

It is an object of this invention to provide an infant swaddling device which is made from washable fabrics.

It is an object of this invention to provide an infant swaddling device which includes an open ended enclosure which fits like a pillow case around the end of the mattress where the head of the infant will rest, thus providing for easy installation or removal of the restraining device to or from the mattress.

It is an object of this invention to provide an infant swaddling device which includes a detachable pocket into which the legs may be placed for extra warmth.

It is an object of this present invention to provide a device which will secure a baby on a mattress in a crib as well as in an incubator.

It is an object of the present invention to provide a device which will prevent a baby form slipping down an inclined mattress and maintain the baby's head in a raised position.

It is an object of the present invention to provide a device which will maintain a baby's head held in a raised position and prevent the baby from slipping down an inclined mattress.

It is an object of the present invention to provide a device which will secure a baby in a selected position on a mattress wherein the device is a blanket with a harness providing a swaddle to sooth the baby and an optional pouch for extra warmth.

It is an object of the present invention to provide an I-shaped harness in which the side panels can be incorporated together with a leg warmer pocket disposed beneath the swaddle together with a pocket shaped piece of fabric connected to the bottom edge of the slip cover by sewing, a zipper, hook and loop fasteners or other fastening means allowing the baby's legs to be inserted and held within whereby the free ends of the swaddle are then pulled up around the baby's chest, (and arms if so desired) and fastened to complete the swaddling of the baby.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

In accordance with the present invention, there is provided an infant positioning and swaddling apparatus which utilizes a portion of a slip cover cooperatively engaging a top portion of a conventional mattress of a crib.

Figure 1:
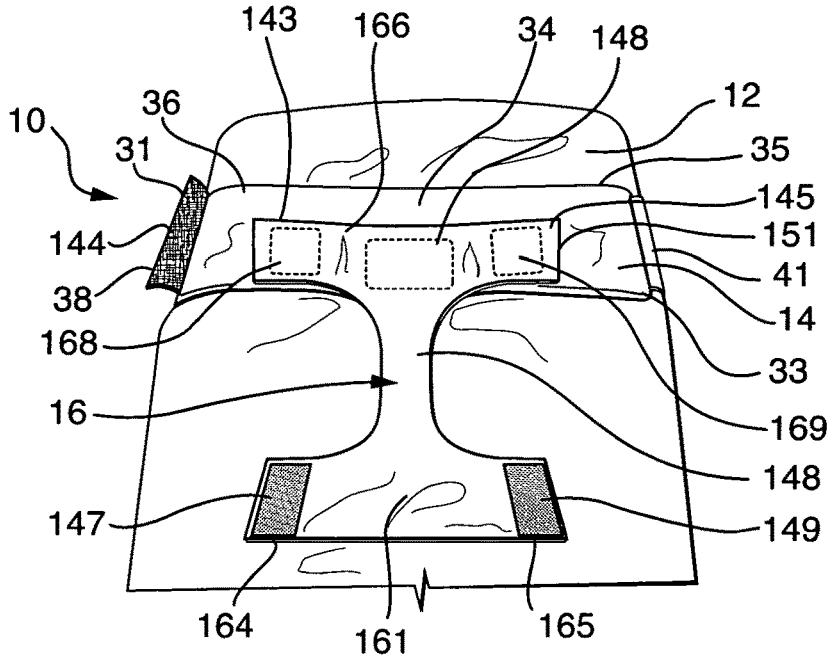
FIG. 1 is a perspective view of the infant harness and swaddling device on a mattress in a baby crib showing a cover fitting over a head of a mattress covering the top, bottom, side edges and top edge of a portion of the mattress with the outer swaddle sewn to the pillowcase-like slip cover, an inner harness sewn to swaddle and slipcover, and VELCRO fasteners on the top and bottom side flaps for cooperative engagement.
Figure 2:
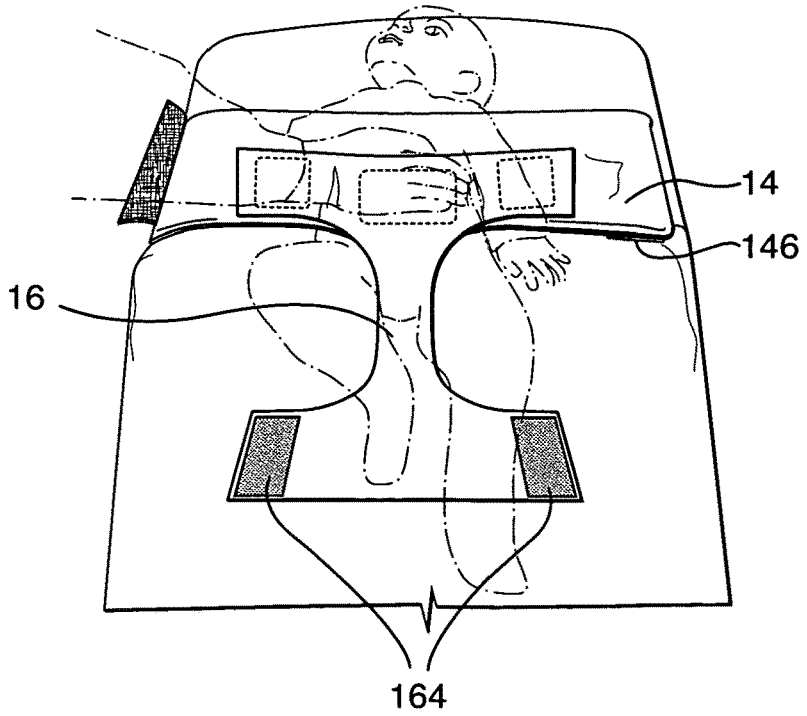
FIG. 2 is a perspective view of an infant being positioned and centered with respect to the inner harness showing the side and bottom flaps lying flat on the outer swaddle lying on the mattress.
Figure 3:
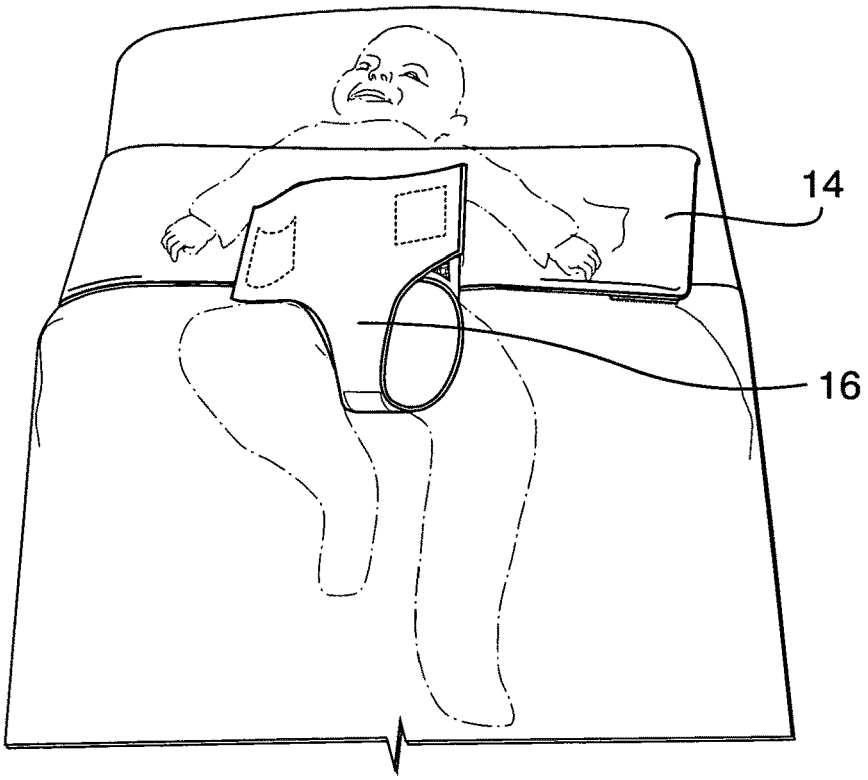
FIG. 3 is a perspective view of an infant being positioned and centered with respect to the inner harness showing the side and bottom flaps folded around the baby and the outer swaddle lying on the mattress.
Figure 4:
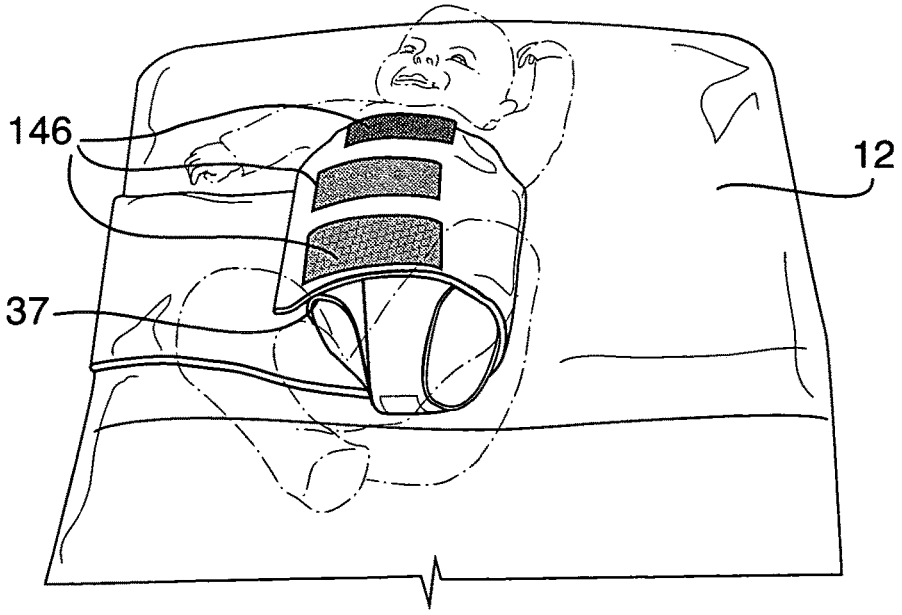
FIG. 4 is a perspective view of the harness and swaddle showing the fastener material on a bottom edge portion of the top outer side swaddle panel placed around the inner harness and the infant's chest while leaving the arms free to move.
Figure 5:
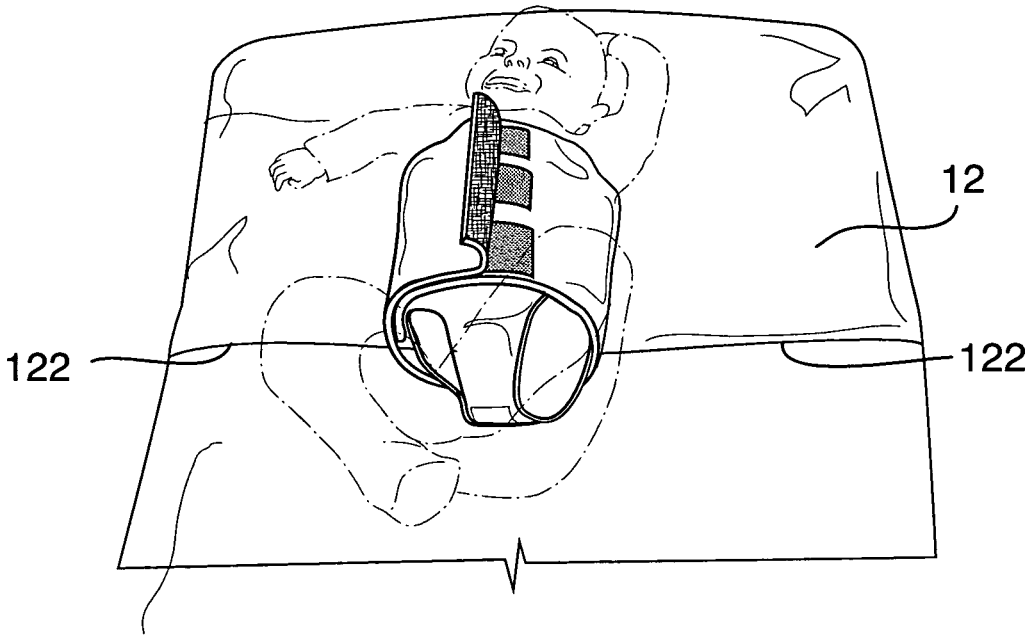
FIG. 5 is a perspective view of the harness and swaddle showing the fastener material on a bottom edge portion of the top outer side swaddle panel removably attaching to the fastener material on a top edge portion of the top inner side swaddle panel placed around the inner harness of the infant's chest while leaving the arms free to move.
Figure 6:
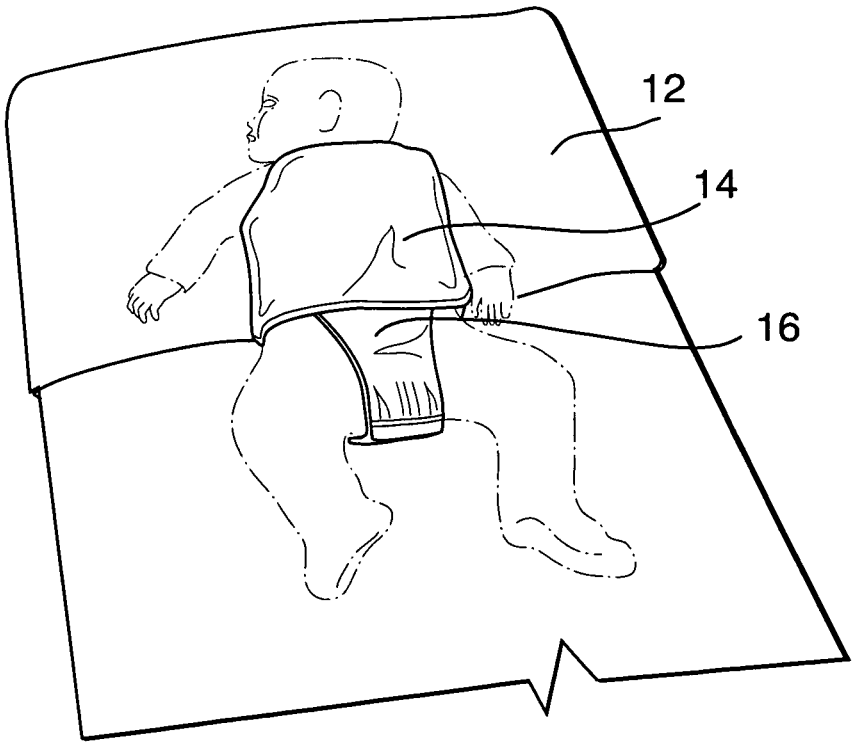
FIG. 6 is a perspective view of the infant swaddled in the device by the overlapping swaddle side flaps secured with VELCRO with the baby's arm's remaining free and bottom portion of the harness disposed between the baby's legs attaching to the center section of the harness covered by the swaddle showing a crotch length adjustment means.
Figure 7:
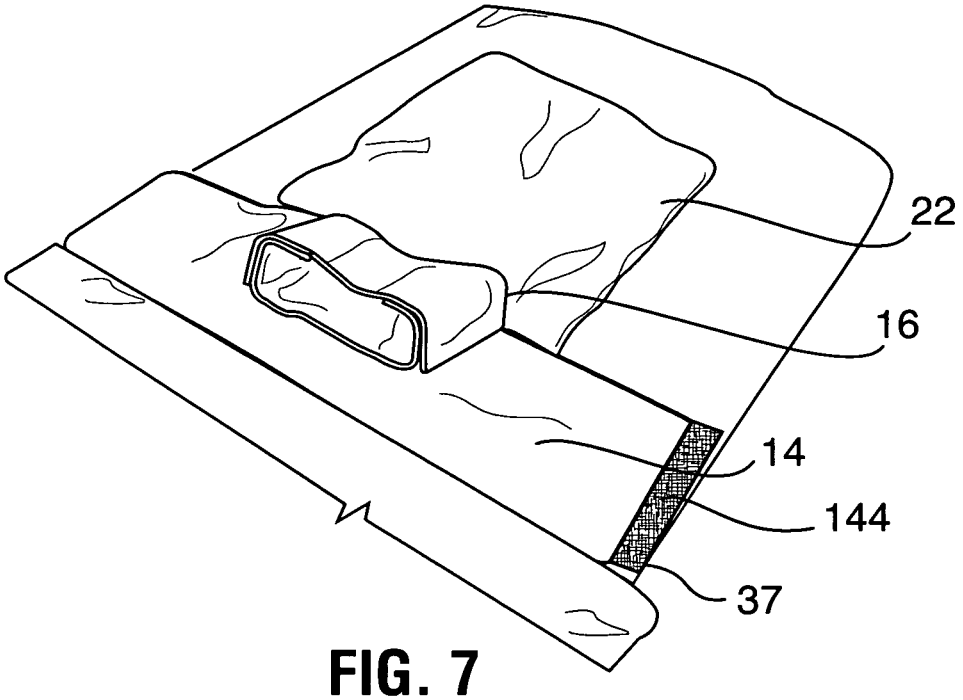
FIG. 7 is a perspective view showing a leg pouch attached to the bottom edge of the slip cover top sewing, VELCRO, snaps, zipper, buttons and holes, adhesives or other attachment means in proximity to the harness and/or swaddle whereby the baby's legs can be tucked into the pouch for warmth.
Figure 8:
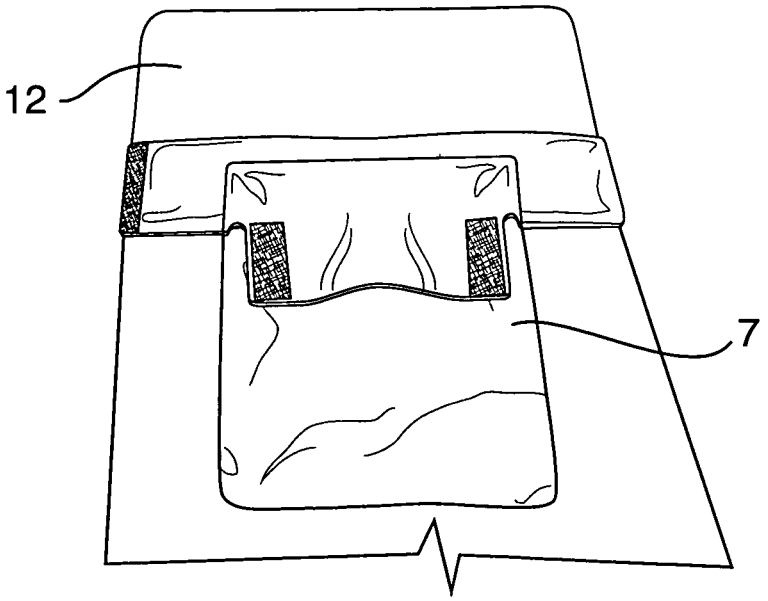
FIG. 8 is a perspective view showing the harness panels flaps positioned for wrapping around the infant with a central back panel attached to a swaddle having opposing side panels extending outward open therefrom and a pouch for containing the bottom portion of the harness and infant's legs therein.

The harness and swaddling apparatus 10 includes a base comprising a slip cover 12 which fits over the head of the mattress and covers about one third of the mattress, as shown in FIGS. 1-3. The slip cover 12 fits tightly over the mattress but is easy to remove as well. The slip cover 12 comprising a pouch which slides over a selected top portion of a mattress/mattress pad covering the swaddle, bottom panel, side edge panels and top edge panel of the mattress. An outer swaddle 14 and an inner harness 16 are attached to the slip cover by sewing, adhesives, hoop and loop fasteners, or other attachment means.

The swaddle 14 has a long top edge, a long bottom edge, and two short lateral edges. The swaddle 14 covers a portion of the slip cover 12 and stretches across the surface of the slip cover 12 spaced apart from the top edge of the mattress 20 a selected distance with the bottom edge 33 of the swaddle 14 placed directly over and in alignment with the bottom slip cover edge 122 of the slip cover 12. Of course, the placement of the swaddle 14 is not critical so long as the infant's head rests upon the top of the mattress above the swaddle 14 so that the torso of the infant can be placed on the swaddle 14. In one preferred embodiment, a selected central portion 34 of the swaddle 14 is immovably affixed or sewn to the top surface of the slip cover so that the bottom edge of the slip cover is generally parallel to the bottom edge of the swaddle wrap 14.

The swaddle 14 is long enough to stretch across the width of the top surface of the slip cover 12 toward the lateral edges of the mattress, and in one preferred embodiment comprises a strip of material about ten to twelve inches wide extending a selected length normal to the length of the mattress comprising a central back portion 34 and side sections or right side panel 35 and left side panel 36 extending therefrom. An inner surface of the outer portion 31 of side panel 36 includes a removable fastening means such as snaps, buttons and loops, zipper, or preferably a patch or strip of hook and loop material 144 such as VELCRO on the surface adjacent the distal end edge 37 stretching across a selected width of the swaddle 14 forming a fastening panel 38. Moreover, the bottom surface of right side panel 35 includes corresponding removable fastening means such as snaps, buttons and loops, zipper, or preferably a patch or strip of hook and loop material 144 such as VELCRO on the top surface stretching across a selected width of the swaddle 14 forming a corresponding fastening panel 41 for cooperatively engaging fastening panel 38.

In one embodiment, three lengths of parallel patches of hook material 146 are at the opposite end of the top panel 14 on the underside of fastening panel 41. These patches 146 are preferably four to eight inches long, thus providing for a large range of girths around which the swaddle 14 can reach. In the figures, the infant is shown with his arms free, but, when desired, the arms can be laid by the side of the infant and then included inside the swaddle as it is fastened closed. This, of course, will require a longer amount of panel, which is provided by the longer patches 146.

A generally "I-shaped" harness panel 16 is centrally disposed with respect to the swaddle 14. The harness 16 includes a top bar 166 disposed over the center of the swaddle 14 so that the bottom edge of the top bar 166 is in alignment with the bottom edge of the swaddle 14. An integral central longitudinal strip extending therefrom connects a bottom bar 161 thereto. The harness includes a crotch adjustment means 7 comprising snaps, elastic, hook and loop attachments (VELCRO), buttons and button holes, and other means for fastening to shorten or lengthen the strip in accordance with the size of the infant. The a selected portion of the inner harness 16 is sewn to the outer swaddle 14, the pillowcase or slip cover 12, or both. The slip cover 12, the swaddle 14 and the harness 16 are fixedly connected to one another by holding means such as by sewing, adhesives, button and loops, hook and loops, etc., preferably with strong thread stitched at the center of the top bar 166 of the I-shaped panel. The stitching is preferably over a sufficient area of, for example, a three inch by three inch area to help maintain correct alignment of the panels with the slip cover 12 as described above. In a preferred embodiment a central portion 148 of the harness is sewn to a central portion of the swaddle 14 and cover slip there beneath.

Removable holding or fastening means are attached to the underside of the free distal end 151 of right top harness flap 143 and free distal end 153 of top harness flap 145 of the top bar 166 of the harness 16. At least two strips or patches of hook material 168 and 169 are attached by thread stitched as shown in FIG. 1. Removable holding or fastening means are attached to the top surface of the two free ends of the left bottom harness flap 147 and right top harness flap 149 of the bottom bar 161 of the harness 16 such as at least two patches of loop material 164 and 165. The central section or central bar 148 is perpendicular to and connects left and right side flaps 143, 145 of the top bar 166 and to the corresponding the bottom bar 161 and is preferably ten to fifteen inches long, providing a large enough area in which to lay the child and then to pull the bottom bar 161 up between the legs and fasten the loop material patches 164 and 165 to the mating hook material patches 168 and 169, respectively. The top and bottom bars 166 and 161 are preferably fourteen to eighteen inches long and three to four inches wide. Downward movement of the infant is limited by selected adjustment of the bottom bar 161 with respect to the top bar 166.

Figure 9:
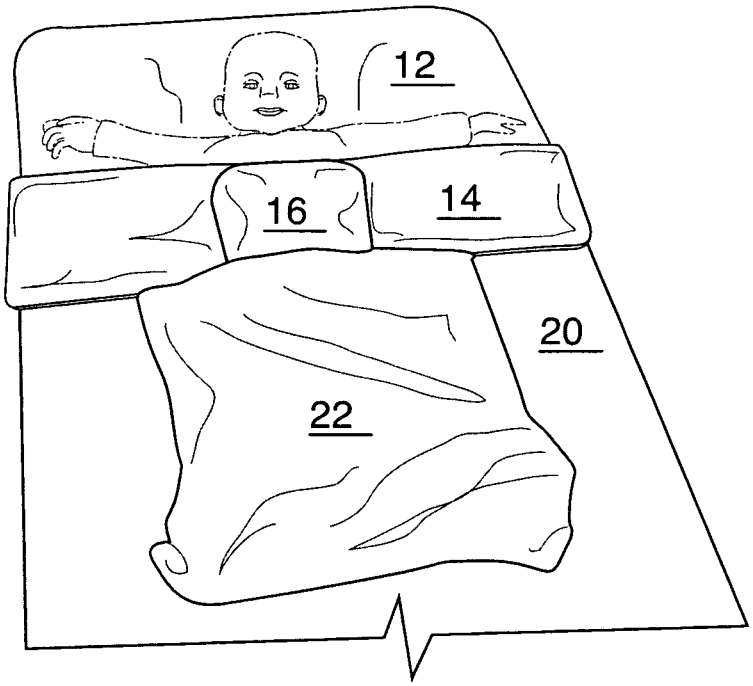
FIG. 9 is a perspective view showing a leg pouch attached to the bottom edge of the slip cover and showing the bottom flaps of the harness folded inward so that the distal ends of the bottom side flaps of the harness overlap and cover the outside surface of the top side flaps of the harness with the hook and loop fasteners of the bottom flap cooperatively engaging corresponding hook and loop fasteners on the outer side panels of top side flaps of the harness forming a cradle limiting movement of the infant and whereby the baby's legs can be tucked into the pouch for warmth.
Figure 10:
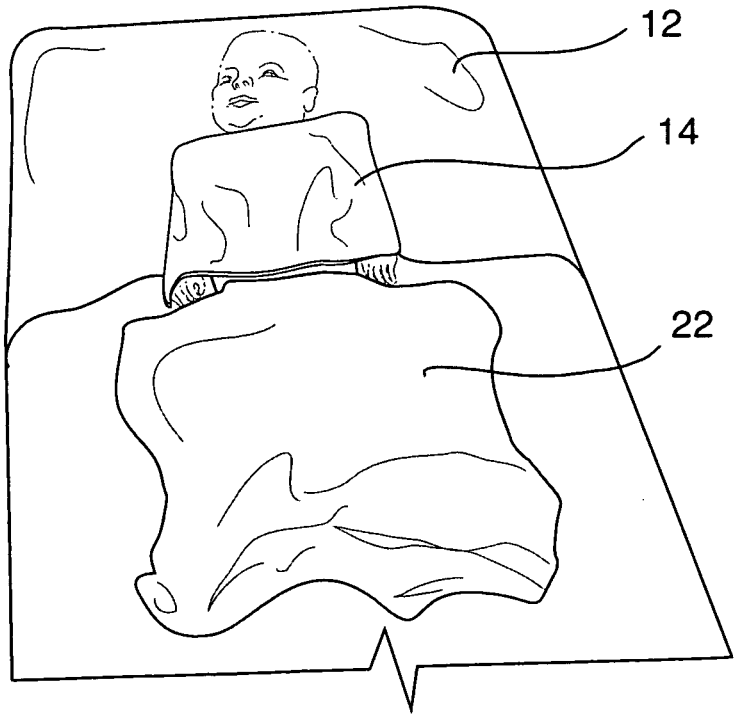
FIG. 10 is a perspective view showing the opposing side panels of the swaddle wrap overlapping one another and holding the infant's arms immovably against the outer surface of the harness and the bottom portion of the harness and infant's legs disposed within the pouch pocket.

As shown best in FIG. 9, when the infant is positioned lying on its back on the central portion 171 of the top bar 166 of the harness 16, the top harness flaps 145, 147 are folded inwardly forming lateral sides with the free distal end panels 151 and 153 extending over the top of the infant's torso. The free distal end panels may overlap and be removably attached to one another to connect the free distal end panels 151 and 153. It is important that the infant's arms remain outside of the inner harness flaps and that the infant is secured snugly but has sufficient room to wiggle. The bottom bar 161 is folded upward over the top bar bar 166 and the fastening means on the bottom flaps 147 and 149 cooperatively engage the fastening means on the outer surface of top bar 166.

The infants arms are then lowered beside the harness and the panels 35 and 36 of the swaddle 14 are folded over the infant's arms and the harness 16 to restrict movement of the infant's arms or the infant's arms may remain free outside of the swaddle 14.

One embodiment of the present invention includes a permanent or a removable or detachable leg pouch 22. The pouch may include gussets which allow the pouch to blouse out and hold a greater volume than without gussets. A selected portion, such as the top portion of the pouch may be permanently or removably attached to the slip cover, harness, swaddle, or combinations thereof by attachment means such as a zipper, hook and loop fasteners, or preferably be sewn into the upper marginal edge thereof to secure a baby's lower torso within the pouch and/or attached to the edge of the swaddle and/or harness. Other means for fixing the pouch to the mattress include buttons, zippers, hook and eye fasteners, straps, ties and the like, and combinations thereof fastened to the mattress by holding means such as hook and loop fasteners "VELCRO", a buckle, zip ties, or other strap securing means.

In one preferred embodiment, the optional removable pouch is affixed to a central position on a top surface of the mattress. The pouch comprises a bottom and top panel of material, wherein the bottom panel of material and/or the side and/or bottom edges of the pouch are fixed to the slip cover on a mattress along a lower marginal edge and along both lateral marginal edges of the blanket portion.

The harness 16 securely holds the baby with its head in an upright position on a level or an inclined plane such as a raised mattress whereby the pouch is secured to the edge of the harness or swaddle or both. The pouch and swaddle provide warmth and security and the harness prevents the baby from rolling or sliding toward the bottom of the inclined mattress.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

We claim:

1. An infant positioning and swaddling device comprising:

a slip cover base comprising woven fabric forming a first pocket for removably configuring over a head end of a baby mattress and covering a selected portion of said baby mattress, said slip cover having a top surface and an edge configure for stretching across a width of said top surface of said slip cover, a top swaddle comprising woven fabric and stretching across the width said top surface of said slip cover, said swaddle being rectangular and having a long top edge, a long bottom edge, and two short lateral edges, said bottom long edge of said swaddle being placed directly over said edge of said top surface of said slip cover, said swaddle having a first patch of hook and loop material on a top surface at one end, said first patch of hook and loop material stretching along one of said two short lateral edges of said swaddle, said swaddle having patches of hook and loop material fixedly connected on the underside of said top bar at an opposite end of said top panel on the underside of said swaddle; and an I-shaped harness panel comprising woven fabric having a top bar, a bottom bar and a middle bar perpendicular to and connecting said top bar and said bottom bar at a respective centers of said top and bottom bars, said I-shaped harness panel situated with said top bar over a center of said swaddle so that a bottom edge of said top bar is also directly over a bottom edge of said swaddle, said slip cover, said swaddle and said I-shaped panel fixedly connected to one another at the center of said top bar over a selected area, two free ends of said top bar having patches of hook and loop material fixedly connected on the underside of said top bar, two free ends of said bottom bar having patches of hook and loop material fixedly connected on a top surface of said bottom bar.

2. The infant positioning and swaddling device of claim 1, wherein a selected central portion of said swaddle is immovably affixed to said top surface of said slip cover and a bottom edge of said slip cover is generally parallel to a bottom edge of said swaddle.

3. The infant positioning and swaddling device of claim 1 wherein said slip cover comprises a pouch for sliding over a selected portion of said mattress or a mattress pad.

4. The infant positioning and swaddling device of claim 3 wherein said slip cover covering said swaddle, a bottom panel of said mattress, a right side edge panel of said mattress, a left side edge panel of said mattress, and a top edge panel of said mattress.

5. The infant positioning and swaddling device of claim 1 said swaddle and an inner harness attaching to said slip cover by a fastener selected from the group consisting of sewing, buttons, snaps, a zipper an adhesive, a hoop and loop fastener.

6. The infant positioning and swaddling device of claim 1, further including a leg pouch attached to said slip cover, said harness or said swaddle.

7. A device for securing a baby in a selected position on a mattress comprising:

a slip cover comprising woven fabric forming a first pocket for removably configuring over a head end of a mattress and covering a selected portion of said mattress, said slip cover having a top surface and an edge configure for stretching across a width of said top surface of said slip cover, and a swaddle comprising woven fabric and stretching across said width of said top surface of said slip cover, said swaddle being rectangular and having a long top edge, a long bottom edge, and two short lateral edges, said bottom long edge of said swaddle being placed directly over said edge of said top surface of said slip cover, said swaddle having a first fastener affixed to a top surface at one end, said first fastener stretching along one of said two short lateral edges of said swaddle, said swaddle having a second fastener at an opposite end of said top surface on the underside of said swaddle;

an I-shaped harness panel comprising woven fabric having a top bar, a bottom bar and a middle bar perpendicular to and connecting said top bar and said bottom bar at a respective centers of said top and bottom bars, said I-shaped harness panel positioned with said top bar aligned over a center of said swaddle so that a bottom edge of said top bar is aligned over a bottom edge of said swaddle, whereby said slip cover, said swaddle, and said I-shaped harness panel fixedly connected to one another at said center area of said top bar, whereby opposing free ends of said top bar having a third fastener fixedly connected on the underside of said top bar, and two free ends of said bottom bar having a fourth fastener fixedly connected on a top surface of said bottom bar.

8. The infant positioning and swaddling device of claim 7, wherein said slip cover comprises a pouch for sliding over a selected portion of said mattress or a mattress pad.

9. The infant positioning and swaddling device of claim 7 said swaddle and an inner harness attaching to said slip cover by a fastener selected from the group consisting of sewing, buttons, snaps, a zipper an adhesive, a hoop and loop fastener, and combinations thereof.

10. The infant positioning and swaddling device of claim 7 said fastener selected from the group consisting of an adhesive, snaps, buttons, a hoop and loop fastener, and combinations thereof.

11. The infant positioning and swaddling device of claim 7 including a leg pouch attached to said slip cover, or to said harness, or to said swaddle.

12. The infant positioning and swaddling device of claim 7 including a removable leg pouch and leg pouch having a selected portion of said leg pouch removably attached to said slip cover, or to said harness, or to said swaddle.

13. The infant positioning and swaddling device of claim 12 wherein said removable leg pouch and leg pouch fastener is selected from the groups consisting of an adhesive, snaps, buttons, a hoop and loop fastener, a buckle, a tie, a zipper.

14. A device for securing a baby in a selected position on a mattress comprising:

a slip cover base comprising woven fabric forming a first pocket for configuring over a head end of said mattress and covering about one third of said mattress, said slip cover having a top surface and an edge for configuring across a width of said top surface of said slip cover;

a top swaddle comprising woven fabric and stretching across said width of said top surface of said slip cover, said swaddle being rectangular and having a long top edge, a long bottom edge, and two short lateral edges, said bottom long edge of said swaddle being placed directly on said top surface at one end of said slip cover, said swaddle having a patch of hook and loop material on a top surface at one end, said patch of hook and loop material stretching along one of said two short lateral edges of said swaddle, said swaddle having at least one patch of hook and loop material at an opposite end of said top surface on an underside of said swaddle; and an I-shaped harness panel comprising woven fabric having a top bar, a bottom bar and a middle bar perpendicular to and connecting said top bar and said bottom bar at a receptive center of said top and bottom bars, said I-shaped harness panel situated with said top bar over a center of said swaddle so that a bottom edge of said top bar is aligned over a bottom edge of said swaddle, said slip cover, said swaddle and said I-shaped panel fixedly are connected to one another with a fastener at a center of said top bar over a selected area, two free ends of said top bar having patches of hook and loop material fixedly connected on the undersides thereof, two free ends of said bottom bar having at least one patch of hook and loop material fixedly connected on a top surface of said bottom bar.

15. The infant positioning and swaddling device of claim 14, wherein a selected central portion of said swaddle is affixed to said top surface of said slip cover and a bottom edge of said slip cover is generally parallel to a bottom edge of said swaddle.

16. The infant positioning and swaddling device of claim 14, wherein said slip cover comprises a pouch for sliding over a selected portion of said mattress or a mattress pad.

17. The infant positioning and swaddling device of claim 16, wherein said slip cover including said swaddle covers, a bottom panel of said mattress, a right side edge panel of said mattress, a left side edge panel of said mattress, and a top edge panel of said mattress.

18. The infant positioning and swaddling device of claim 14 said swaddle and an inner harness attaching to said slip cover by a fastener selected from the group consisting of sewing, buttons, snaps, a zipper an adhesive, and a hoop and loop fastener.

19. The infant positioning and swaddling device of claim 14 said fastener selected from the group consisting of an adhesive, snaps, buttons, and a hoop and loop fastener.

20. The infant positioning and swaddling device of claim 14 including a leg pouch having a selected portion attached to said slip cover, or to said harness, or to said swaddle.

21. The infant positioning and swaddling device of claim 14 including a removable leg pouch and leg pouch fastener having a selected portion of said leg pouch removably attached to said slip cover, or to said harness, or to said swaddle.

22. The infant positioning and swaddling device of claim 21 wherein said removable leg pouch and leg pouch fastener is selected from the groups consisting of an adhesive, snaps, buttons, a hoop and loop fastener, a buckle, a tie, and a zipper.

* * * * *